US011906195B2

(12) United States Patent
Hayashi et al.

(10) Patent No.: US 11,906,195 B2
(45) Date of Patent: Feb. 20, 2024

(54) INDOOR UNIT OF AIR-CONDITIONING APPARATUS AND AIR-CONDITIONING APPARATUS

(71) Applicant: Mitsubishi Electric Corporation, Tokyo (JP)

(72) Inventors: Tsuyoshi Hayashi, Tokyo (JP); Kazuhito Kojima, Tokyo (JP); Hisanori Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 752 days.

(21) Appl. No.: 17/040,715

(22) PCT Filed: May 16, 2018

(86) PCT No.: PCT/JP2018/018929

§ 371 (c)(1),
(2) Date: Sep. 23, 2020

(87) PCT Pub. No.: WO2019/220566

PCT Pub. Date: Nov. 21, 2019

(65) Prior Publication Data

US 2021/0010713 A1 Jan. 14, 2021

(51) Int. Cl.

| | |
|---|---|
| ***F24F 13/20*** | (2006.01) |
| ***F24F 11/89*** | (2018.01) |
| ***F24F 11/56*** | (2018.01) |
| ***F24F 1/0063*** | (2019.01) |

(52) U.S. Cl.

CPC ..... *F24F 13/20* (2013.01); *F24F 1/0063* (2019.02); *F24F 11/56* (2018.01); *F24F 11/89* (2018.01)

(58) Field of Classification Search

CPC ..... F24F 13/20; F24F 1/0063; F24F 11/56; F24F 11/89; F24F 1/0057

See application file for complete search history.

(56) References Cited

U.S. PATENT DOCUMENTS

2012/0122389 A1* 5/2012 Kishimoto ..... F24F 8/192 454/284

FOREIGN PATENT DOCUMENTS

| | | | | | |
|---|---|---|---|---|---|
| CN | 1521458 | A | | 8/2004 | |
| CN | 101573563 | A | | 11/2009 | |
| CN | 101755173 | A | * | 6/2010 | ..... F24F 1/0011 |
| CN | 1715791 | B | * | 3/2012 | ..... F24F 1/0007 |
| CN | 107101278 | A | * | 8/2017 | |
| CN | 206626684 | U | | 11/2017 | |
| CN | 206959162 | U | | 2/2018 | |
| EP | 2083227 | A1 | | 7/2009 | |

(Continued)

OTHER PUBLICATIONS

Office Action dated Feb. 14, 2022 issued in corresponding CN patent application No. 018800932331 (and English translation).

(Continued)

*Primary Examiner* — Kun Kai Ma
(74) *Attorney, Agent, or Firm* — POSZ LAW GROUP PLC

(57) ABSTRACT

An indoor unit of an air-conditioning apparatus includes a back casing and a first top panel having a first pivot axis under the back casing, the first top panel being configured to be attached to the back casing. The first top panel is configured to be detached from the back casing by opening downward from the back casing around the first pivot axis.

19 Claims, 14 Drawing Sheets

(56) References Cited

FOREIGN PATENT DOCUMENTS

| | | | | |
|---|---|---|---|---|
| EP | 2216608 | A1 | * | 8/2010 |
| EP | 3330630 | A1 | * | 6/2018 |
| JP | 2004-028453 | A | | 1/2004 |
| JP | 2004-138310 | A | | 5/2004 |
| JP | 4365432 | B2 | * | 11/2009 |
| JP | 2013-047589 | A | | 3/2013 |
| JP | 2014-119179 | A | | 6/2014 |
| JP | 2015-031454 | A | | 2/2015 |
| KR | 20060022443 | A | * | 3/2006 |
| WO | WO-02103251 | A2 | * | 12/2002 |
| WO | WO-2013031317 | A1 | * | 3/2013 |
| WO | WO-2013108652 | A1 | * | 7/2013 |

OTHER PUBLICATIONS

Office Action dated Oct. 13, 2021 issued in corresponding CN patent application No. 201880093233.7 (and Machine Translation).
Office Action dated Jun. 4, 2021 issued in corresponding CN patent application No. 201880093233.7 (and English translation).
Extended European Search Report dated Apr. 23, 2021, issued in corresponding European Patent Application No. 18918725.5.
International Search Report of the International Searching Authority dated Jul. 31, 2018 for the corresponding International application No. PCT/JP2018/018929 (and English translation).

* cited by examiner

INDOOR UNIT OF AIR-CONDITIONING APPARATUS AND AIR-CONDITIONING APPARATUS

CROSS REFERENCE TO RELATED APPLICATION

This application is a U.S. national stage application of PCT/JP2018/018929 filed on May 16, 2018, the contents of which are incorporated herein by reference.

TECHNICAL FIELD

The present invention relates to an indoor unit of an air-conditioning apparatus and an air-conditioning apparatus. The indoor unit includes top panels configured to be attached to a back casing.

BACKGROUND ART

In the related art, if a top panel of a casing of an indoor unit needs to be replaced due to, for example, damage, the top panel is detached by opening upward around the upper back end portion thereof serving as a pivot axis (for example, see Patent Literature 1).

CITATION LIST

Patent Literature

Patent Literature 1: Japanese Unexamined Patent Application Publication No. 2015-31454

SUMMARY OF INVENTION

Technical Problem

In a technique in Patent Literature 1, the shape design of the indoor unit needs to be made such that a remote-control communication unit at a lower position in the top panel is disposed outside a pivot path region. The pivot path region includes a path along which the top panel to be detached pivots.

The present invention is made to solve the above problem, and an object of the present invention is to provide an indoor unit of an air-conditioning apparatus and an air-conditioning apparatus. In the indoor unit, there are no restrictions on the shape design of a remote-control communication unit at a lower position in the indoor unit.

Solution to Problem

An indoor unit of an air-conditioning apparatus according to an embodiment of the present invention includes a back casing and a first top panel having a first pivot axis under the back casing, the first top panel being configured to be attached to the back casing. The first top panel is configured to be detached from the back casing by opening downward from the back casing around the first pivot axis.

An air-conditioning apparatus according to another embodiment of the present invention includes the indoor unit of an air-conditioning apparatus.

Advantageous Effects of Invention

In the indoor unit of an air-conditioning apparatus and the air-conditioning apparatus according to the embodiments of the present invention, the first top panel is configured to be detached from the back casing by opening downward from the back casing around the first pivot axis. The expression "downward-opening" means that the first top panel pivots downward from the back casing around the first pivot axis under the back casing. Thus, it is possible to make a shape design of the indoor unit such that a remote-control communication unit at a lower position in the first top panel is disposed outside the pivot path of the first top panel to be detached. As a result, the restriction on the shape design of the indoor unit is eliminated.

DESCRIPTION OF EMBODIMENTS

Figure 1:
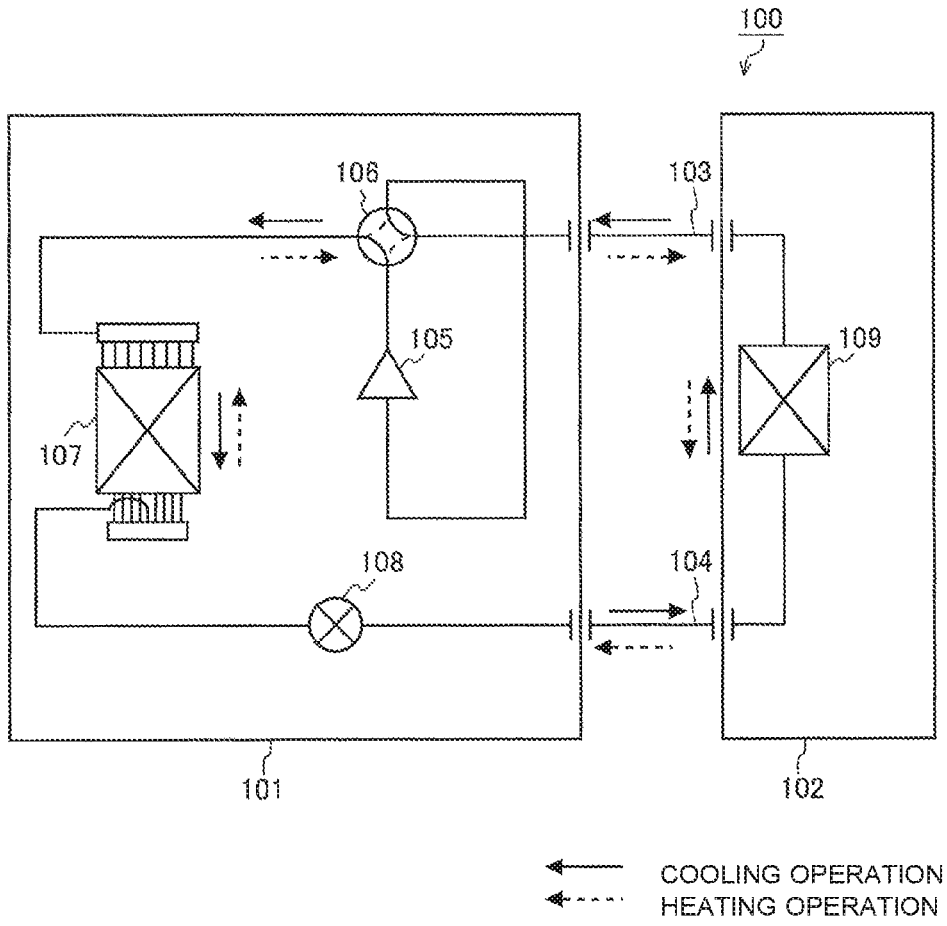
FIG. 1 is a diagram of a refrigerant circuit illustrating an air-conditioning apparatus according to Embodiment 1 of the present invention.

An embodiment of the present invention will be described below with reference to the drawings. In the drawings, components having the same reference signs are the same or corresponding components, and this applies to the whole description. In the sectional views, hatching is omitted as appropriate in view of recognizability. In addition, the forms of the components in the whole description are merely examples, and the forms of the components are not limited to those in the description.

Embodiment 1

<Configuration of Air-conditioning Apparatus 100>

FIG. 1 is a diagram of a refrigerant circuit illustrating an air-conditioning apparatus 100 according to Embodiment 1 of the present invention. In the air-conditioning apparatus 100 illustrated in FIG. 1, an outdoor unit 101 and an indoor unit 102 are connected by a gas refrigerant pipe 103 and a liquid refrigerant pipe 104.

The outdoor unit 101 includes a compressor 105, a four-way valve 106, an outdoor heat exchanger 107, and an expansion valve 108.

The compressor 105 compresses and discharges suctioned refrigerant. The compressor 105 may vary the amount of refrigerant sent by the compressor 105 per unit time by freely varying operating frequency with, for example, an inverter circuit.

The four-way valve 106 is a valve that switches between, for example, a refrigerant flow in a cooling operation and a refrigerant flow in a heating operation.

The outdoor heat exchanger 107 exchanges heat between refrigerant and outdoor air. The outdoor heat exchanger 107 functions as a condenser in the cooling operation and condenses and liquifies refrigerant. The outdoor heat exchanger 107 functions as an evaporator in the heating operation and evaporates and gasifies refrigerant.

The expansion valve 108 is a flow control valve and decompresses and expands refrigerant. For example, in the case of the expansion valve 108 composed of an electronic expansion valve, the opening degree of the expansion valve 108 can be controlled by instructions from a controller (not illustrated) or other devices.

The indoor unit 102 includes an indoor heat exchanger 109. For example, the indoor heat exchanger 109 exchanges heat between air-conditioning target air and refrigerant. The indoor heat exchanger 109 functions as an evaporator in the cooling operation and evaporates and gasifies refrigerant. The indoor heat exchanger 109 functions as a condenser in the heating operation and condenses and liquifies refrigerant.

As described above, the configuration of the air-conditioning apparatus 100 enables refrigerant flows to be switched with the four-way valve 106 of the outdoor unit 101, and thus the cooling operation and the heating operation can be performed.

<Configuration of Indoor Unit 102 of Air-conditioning Apparatus 100>

Figure 2:
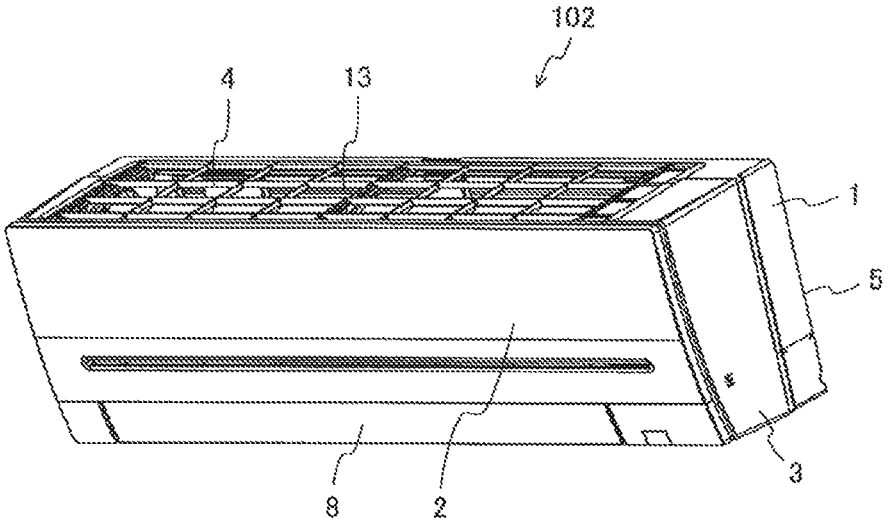
FIG. 2 is an external perspective view illustrating an indoor unit of the air-conditioning apparatus according to Embodiment 1 of the present invention.
Figure 3:
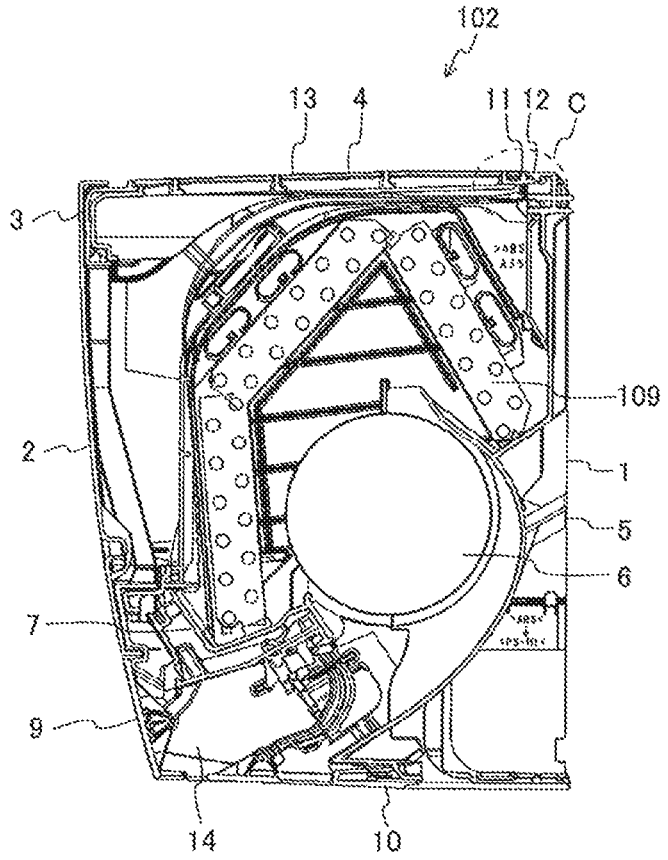
FIG. 3 is a longitudinal sectional view illustrating the vicinity of the center of the indoor unit of the air-conditioning apparatus in the lengthwise direction according to Embodiment 1 of the present invention.
Figure 4:
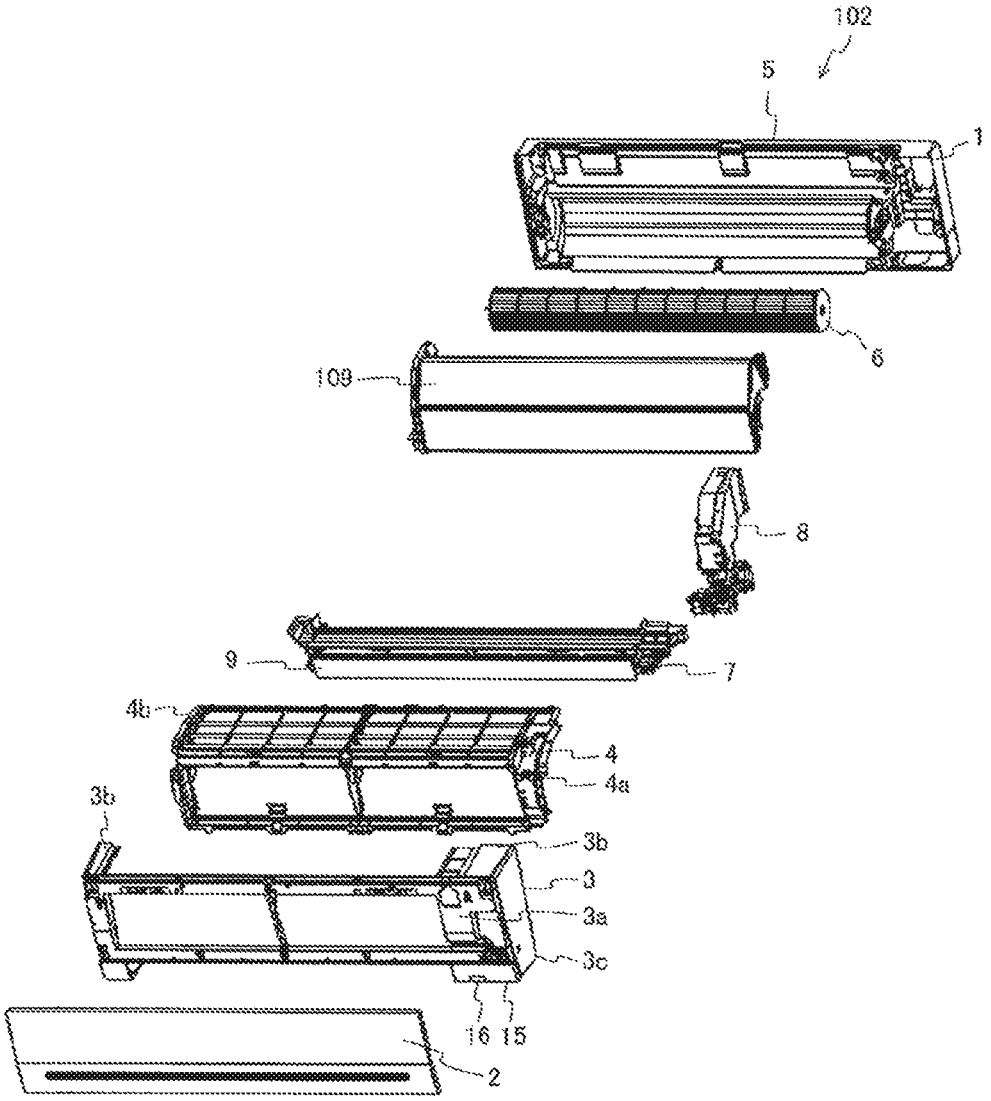
FIG. 4 is an exploded perspective view illustrating the indoor unit of the air-conditioning apparatus according to Embodiment 1 of the present invention.

FIG. 2 is an external perspective view illustrating the indoor unit 102 of the air-conditioning apparatus 100 according to Embodiment 1 of the present invention. FIG. 3 is a longitudinal sectional view illustrating the vicinity of the center of the indoor unit 102 of the air-conditioning apparatus 100 in the lengthwise direction according to Embodiment 1 of the present invention. FIG. 4 is an exploded perspective view illustrating the indoor unit 102 of the air-conditioning apparatus 100 according to Embodiment 1 of the present invention.

As illustrated in FIG. 2, the indoor unit 102 of the air-conditioning apparatus 100 includes a back casing 1, a front design panel 2, a first top panel 3, and a second top panel 4. The back casing 1, the front design panel 2, the first top panel 3, and the second top panel 4 form a casing 5 of the indoor unit 102.

As illustrated in FIGS. 3 and 4, in the indoor unit 102 of the air-conditioning apparatus 100, the casing 5 contains the indoor heat exchanger 109, a fan 6, a drain pan 7, and an electric component box 8. When the indoor heat exchanger 109, the fan 6, and the drain pan 7 are viewed from their front sides, the electric component box 8 is disposed on the right to be parallel to the indoor heat exchanger 109, the fan 6, and the drain pan 7.

As illustrated in FIG. 4, the back casing 1 functions as a base when the indoor unit 102, which is a wall-mounted indoor unit, is mounted on an indoor wall. The back casing 1 supports other components of the indoor unit 102. The back casing 1 has a plurality of separate spaces in which the indoor heat exchanger 109, the fan 6, the drain pan 7, and the electric component box 8 are disposed. The gas refrigerant pipe 103 and the liquid refrigerant pipe 104, which connect the outdoor unit 101 and the indoor unit 102, are disposed at the back of the back casing 1 such that refrigerant flows indoors and outdoors.

The indoor heat exchanger 109 exchanges heat between refrigerant and indoor air. The fan 6 is, for example, a cross-flow fan and blows, from the indoor unit 102, the conditioned air that has been subjected to heat exchange in the indoor heat exchanger 109. The drain pan 7 receives condensed water generated during heat exchange in the indoor heat exchanger 109, and the condensed water treated as drain water is discharged from the indoor unit 102. The drain pan 7 includes an airflow direction louver unit 9, which is disposed over an air outlet 14 of the indoor unit 102. The airflow direction louver unit 9 includes an up-down airflow direction louver and a left-right airflow direction louver. The electric component box 8 includes a control unit 8*a* and a remote-control communication unit 8*b*. The control unit 8*a* includes a control board that controls the fan 6, the airflow direction louver unit 9, or other components, and a power supply that applies power to the control board. The remote-control communication unit 8*b* communicates with a remote control.

The front design panel 2 is attached to a first front portion 3*a* of the first top panel 3. The front design panel 2 is a plate-like component whose outer surface design is elaborated.

The first top panel 3 has a first pivot axis 10 under the back casing 1 and is attached to the back casing 1. As described below, the first top panel 3 is configured to be detached from the back casing 1 by opening downward from the back casing 1 around the first pivot axis 10.

The second top panel 4 has a second pivot axis 11 above the back casing 1 and overlaps the inside of the first top panel 3. As described below, the second top panel 4 is configured to be detached from the back casing 1 by opening upward from the back casing 1 around the second pivot axis 11. As illustrated in FIG. 3, the part at the position of the second pivot axis 11 of the second top panel 4 is engaged with the back casing 1 via a claw portion. Details of a claw engagement structure 12 are described below.

<Operation Overview of Indoor Unit 102>

In the indoor unit 102 of the air-conditioning apparatus 100, the fan 6 sucks indoor air through an air inlet 13 in the top of the indoor unit 102. The sucked indoor air is subjected to heat exchange in the indoor heat exchanger 109 to be cool or warm conditioned air. The conditioned air is sent indoors through the air outlet 14, over which the airflow direction louver unit 9 of the drain pan 7 is disposed, and indoor temperature is controlled.

<Details of First Top Panel 3>

Figure 5:
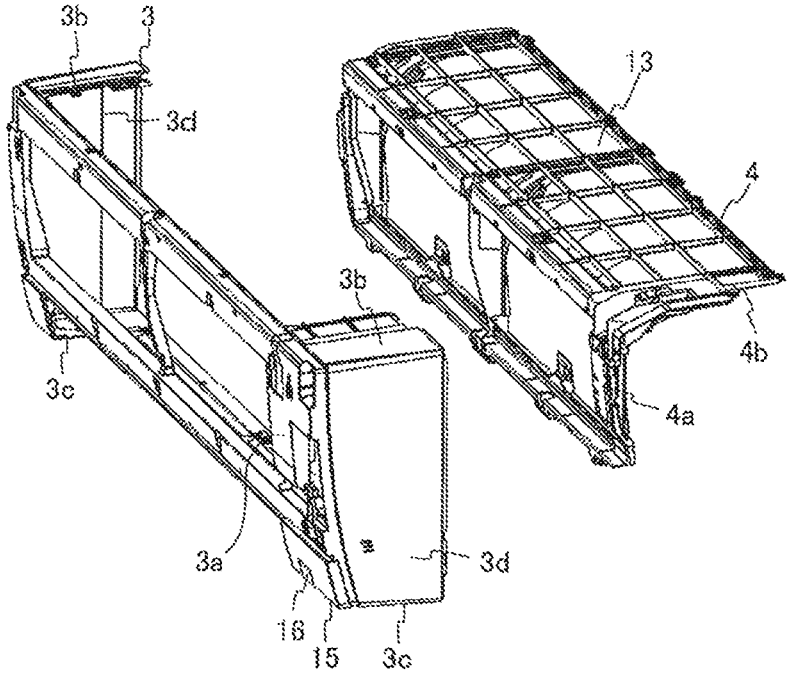
FIG. 5 is an exploded perspective view illustrating a first top panel and a second top panel of the indoor unit of the air-conditioning apparatus according to Embodiment 1 of the present invention.

FIG. 5 is an exploded perspective view illustrating the first top panel 3 and the second top panel 4 of the indoor unit 102 of the air-conditioning apparatus 100 according to Embodiment 1 of the present invention. As illustrated in FIG. 5, the first top panel 3 includes the first front portion 3*a*, first top portions 3*b*, bottom portions 3*c*, and side portions 3*d*. The first front portion 3*a* is formed into a four-sided frame at the front of the indoor unit 102. The two first top portions 3*b* are disposed on respective sides outside the left-right width of the indoor heat exchanger 109. Each of the two first top portions 3*b* is continuous with a corresponding one of the left and right side portions 3*d*. The first top portion 3*b* on the front right side is disposed above the electric component box 8. One of the bottom portions 3*c* is disposed on the first front portion 3*a* via a bent portion 15, into which a lower portion of the first front portion 3*a* closer to the electric component box 8 is bent. The bent portion 15 has an L shape. The remote-control communication unit 8*b* is disposed inside the bent portion 15. A display 16, which is made of, for example, LEDs, is disposed in the bent portion 15. The two side portions 3*d* form left and right side portions of the casing 5 of the indoor unit 102.

<Details of Second Top Panel 4>

As illustrated in FIG. 5, the second top panel 4 includes a second front portion 4*a* and a second top portion 4*b*. The second front portion 4*a* is formed into a four-sided frame at the front of the indoor unit 102. The second front portion 4*a* has a left-right width equal to that of the second top portion 4*b* and is continuous with the second top portion 4*b*. The second top portion 4*b* is formed into a grid that is to be the air inlet 13 within the left-right width of the indoor heat exchanger 109.

<Details of Electric Component Box 8>

Figure 6:
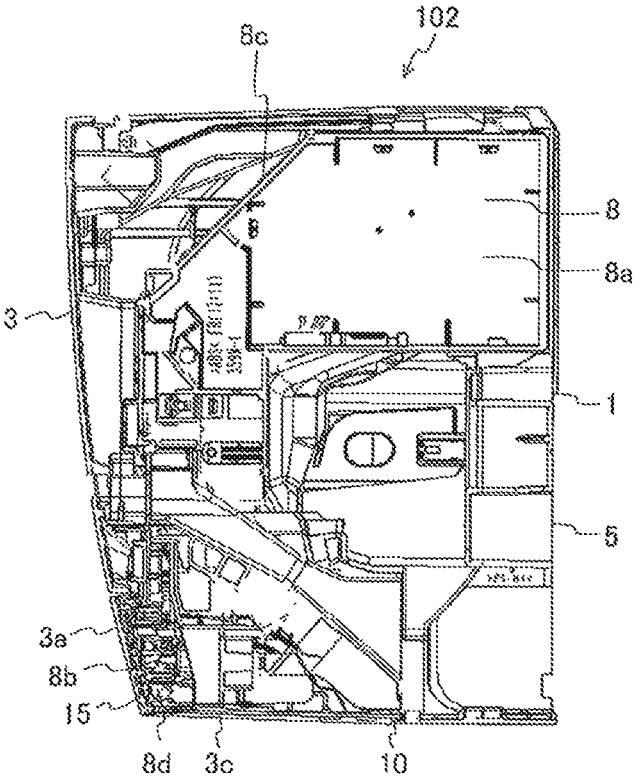
FIG. 6 is a longitudinal sectional view, at the position of an electric component box, illustrating the indoor unit of the air-conditioning apparatus according to Embodiment 1 of the present invention.
Figure 7:
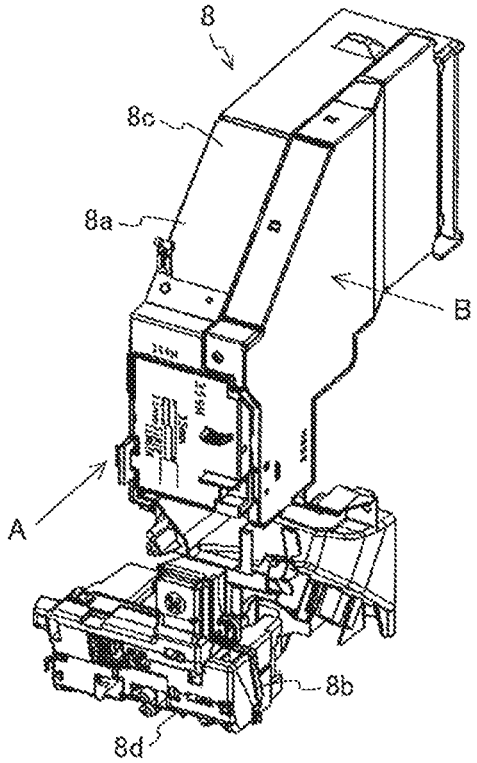
FIG. 7 is a perspective view illustrating the electric component box of the indoor unit of the air-conditioning apparatus according to Embodiment 1 of the present invention.
Figure 8:
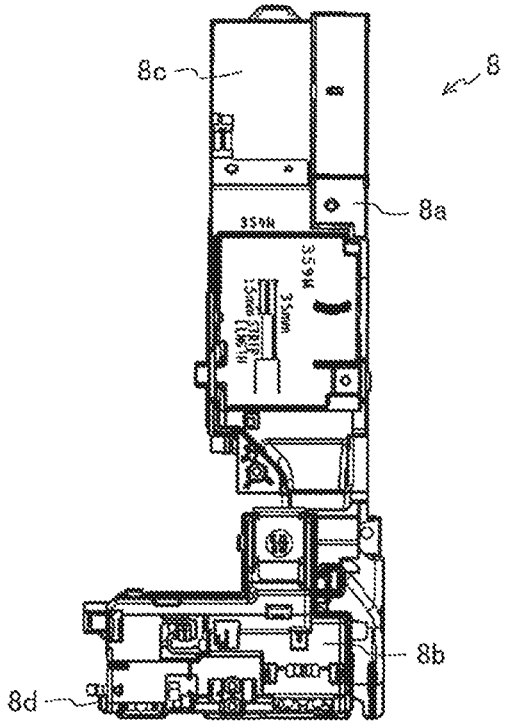
FIG. 8 is a front view illustrating the electric component box of the indoor unit of the air-conditioning apparatus according to Embodiment 1 of the present invention when viewed in the direction of arrow A in FIG. 7.
Figure 9:
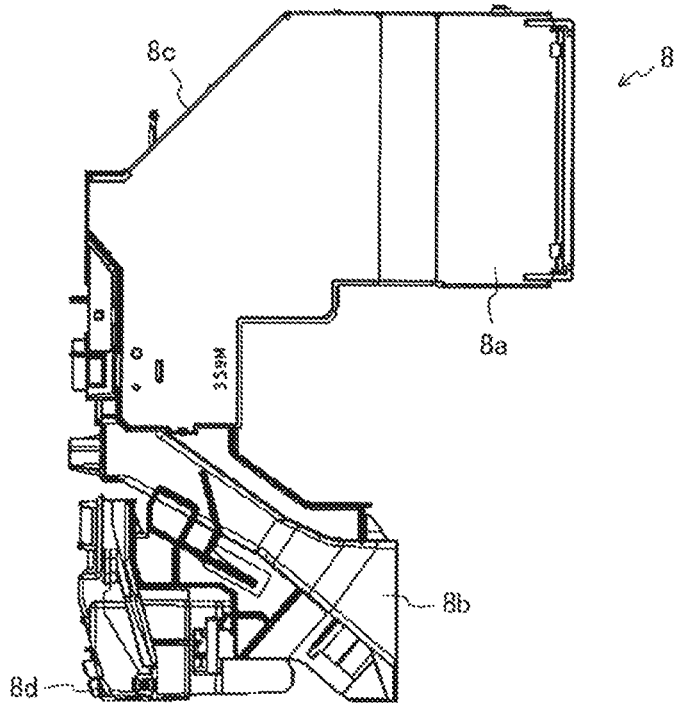
FIG. 9 is a side view illustrating the electric component box of the indoor unit of the air-conditioning apparatus according to Embodiment 1 of the present invention when viewed in the direction of arrow B in FIG. 7.

FIG. 6 is a longitudinal sectional view, at the position of the electric component box 8, illustrating the indoor unit 102 of the air-conditioning apparatus 100 according to Embodiment 1 of the present invention. FIG. 7 is a perspective view illustrating the electric component box 8 of the indoor unit 102 of the air-conditioning apparatus 100 according to Embodiment 1 of the present invention. FIG. 8 is a front view illustrating the electric component box 8 of the indoor unit 102 of the air-conditioning apparatus 100 according to Embodiment 1 of the present invention when viewed in the direction of arrow A in FIG. 7. FIG. 9 is a side view illustrating the electric component box 8 of the indoor unit 102 of the air-conditioning apparatus 100 according to Embodiment 1 of the present invention when viewed in the direction of arrow B in FIG. 7.

The electric component box 8 includes the control unit 8*a* and the remote-control communication unit 8*b*. The control unit 8*a* includes the control board that controls the fan 6, the airflow direction louver unit 9, or other components, and the power supply that applies power to the control board. The remote-control communication unit 8*b* communicates with the remote control. As illustrated in FIG. 4, the electric component box 8 is disposed parallel to one end in the left-right direction of the indoor heat exchanger 109. As illustrated in FIGS. 6 to 9, the electric component box 8 includes, in an upper portion thereof, the control unit 8*a* including the control board and the power supply. The electric component box 8 includes, in a lower portion thereof, the remote-control communication unit 8*b*. The remote-control communication unit 8*b* includes and is integrated with a light-emitting unit including LEDs.

In an upper portion of the electric component box 8, an inclined portion 8*c* is formed such that a front portion thereof is lower than a back portion thereof. The inclined portion 8*c* in an upper portion of the electric component box 8 is disposed outside a downward-opening pivot path region. The downward-opening pivot path region is a pivot path region including a path along which the first top panel 3 moves physically when the first top panel 3 opens downward. In particular, the first top panel 3 includes the first top portion 3*b* on the front right side above the electric component box 8. For this reason, the inclined portion 8*c* in an upper portion of the electric component box 8 is disposed outside the downward-opening pivot path region including a path along which the first top portion 3*b* moves physically when the first top panel 3 opens downward.

The remote-control communication unit 8*b* is disposed inside the bent portion 15 having an L shape. To communicate with the remote control without interference, the remote-control communication unit 8*b* is in contact with the inside of the bent portion 15 having an L shape without a space therebetween. Thus, the remote-control communication unit 8*b* includes a corner portion 8*d*, which has an L shape and is similar to the bent portion 15 having an L shape.

<Details of Claw Engagement Structure 12 of Second Top Panel 4>

Figure 10:
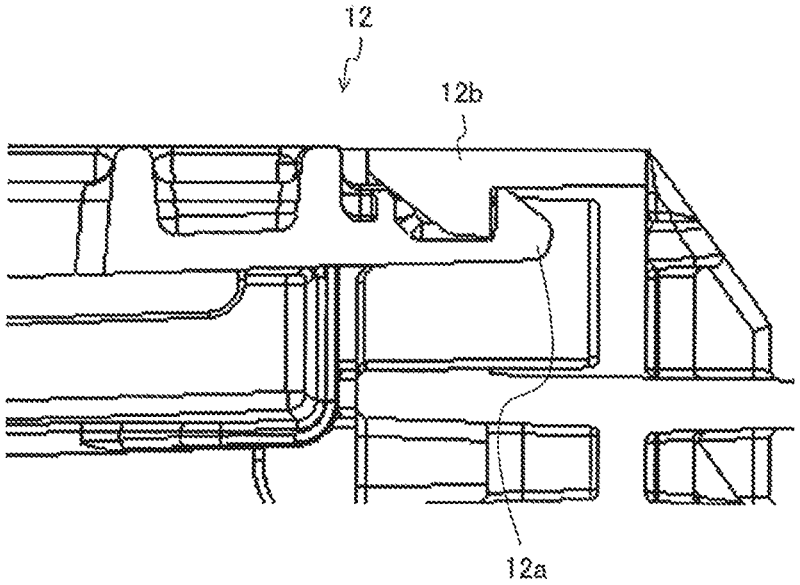
FIG. 10 is an enlarged view of section C in FIG. 3 illustrating a claw engagement structure of the second top panel of the indoor unit of the air-conditioning apparatus according to Embodiment 1 of the present invention.
Figure 11:
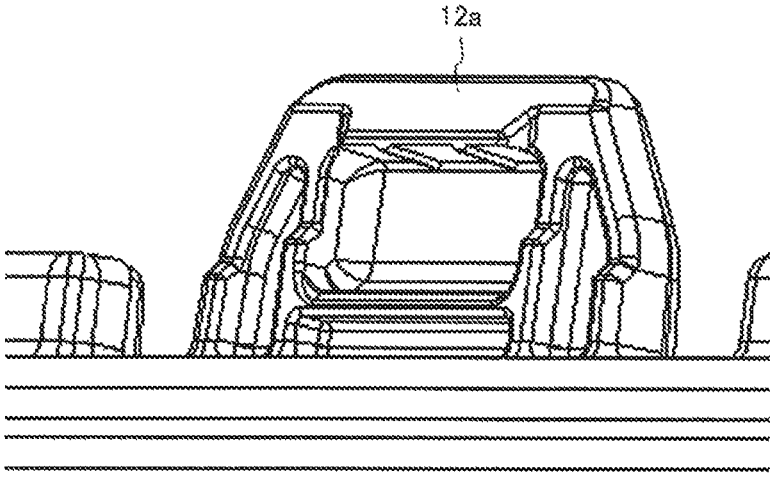
FIG. 11 is a top view illustrating a first claw portion of the second top panel of the indoor unit of the air-conditioning apparatus according to Embodiment 1 of the present invention.
Figure 12:
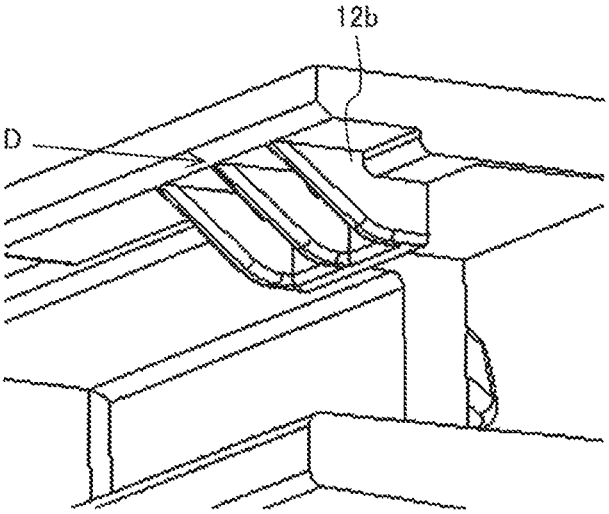
FIG. 12 is a perspective view illustrating a second claw portion of a back casing of the indoor unit of the air-conditioning apparatus according to Embodiment 1 of the present invention.
Figure 13:
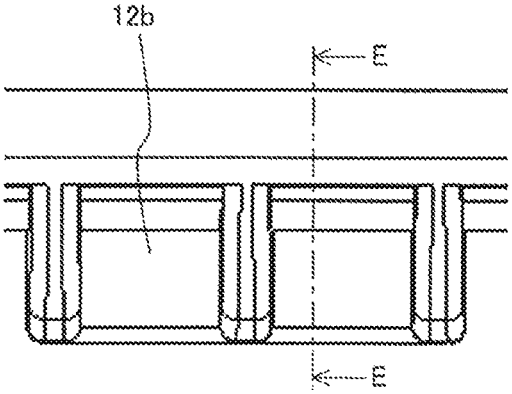
FIG. 13 is a front view illustrating the second claw portion of the back casing of the indoor unit of the air-conditioning apparatus according to Embodiment 1 of the present invention when viewed in the direction of arrow D in FIG. 12.
Figure 14:
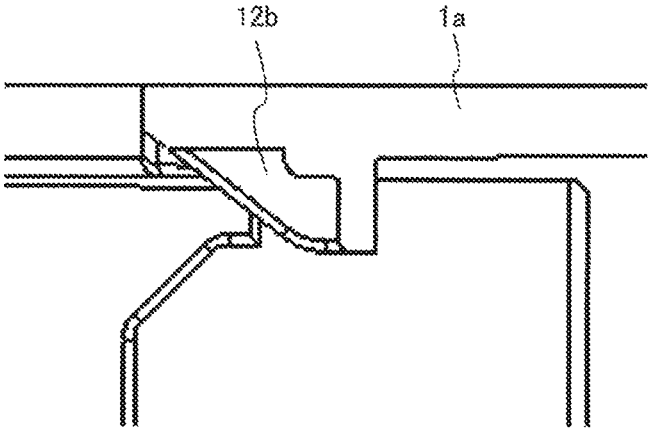
FIG. 14 is a longitudinal sectional view taken along line E-E in FIG. 13 and illustrating the second claw portion of the back casing of the indoor unit of the air-conditioning apparatus according to Embodiment 1 of the present invention.

FIG. 10 is an enlarged view of section C in FIG. 3 illustrating the claw engagement structure 12 of the second top panel 4 of the indoor unit 102 of the air-conditioning apparatus 100 according to Embodiment 1 of the present invention. FIG. 11 is a top view illustrating a first claw portion 12*a* of the second top panel 4 of the indoor unit 102 of the air-conditioning apparatus 100 according to Embodiment 1 of the present invention. FIG. 12 is a perspective view illustrating a second claw portion 12*b* of the back casing 1 of the indoor unit 102 of the air-conditioning apparatus 100 according to Embodiment 1 of the present invention. FIG. 13 is a front view illustrating the second claw portion 12*b* of the back casing 1 of the indoor unit 102 of the air-conditioning apparatus 100 according to Embodiment 1 of the present invention when viewed in the direction of arrow D in FIG. 12. FIG. 14 is a longitudinal sectional view taken along line E-E in FIG. 13 and illustrating the second claw portion 12*b* of the back casing 1 of the indoor unit 102 of the air-conditioning apparatus 100 according to Embodiment 1 of the present invention.

As illustrated in FIGS. 10 and 11, the part at the position of the second pivot axis 11 of the second top panel 4 is formed into the first claw portion 12*a*, which is engaged with the back casing 1. As illustrated in FIG. 10 and FIGS. 12 to 14, the back casing 1 includes the second claw portion 12*b*, which is engaged with the second top panel 4. As illustrated in FIG. 10, the first claw portion 12*a* and the second claw portion 12*b* are engaged with each other.

As illustrated in FIG. 11, the first claw portion 12*a* extends backward and includes, at an end thereof, a tip portion having a barb. The barb of the tip portion faces upward. The first claw portion 12*a* has a recess that holds the second claw portion 12*b* between the tip portion and a base of the first claw portion 12*a* of the second top panel 4. The recess is open upward.

As illustrated in FIGS. 12 to 14, the second claw portion 12*b* protrudes downward from a top portion 1*a* of the back casing 1. The second claw portion 12*b* has inclined surfaces that gradually extend from the front end thereof to a base thereof closer to the back side. The back ends of the inclined surfaces form a barb. The thickness of a back portion of the second claw portion 12*b* is equal to that of the top portion 1*a* of the back casing 1, and thus the back portion of the second claw portion 12*b* can hold the tip portion of the first claw portion 12*a*.

As described above, when the second top panel 4 is pushed into the back casing 1 from the front side, the first claw portion 12*a* and the second claw portion 12*b* respectively slide along the inclined surfaces of the second claw portion 12*b* and an inclined surface of the first claw portion 12*a*. Then, the first claw portion 12*a* and the second claw portion 12*b* are engaged with each other with their barbs not to be disconnected from each other. Meanwhile, the second top panel 4 opens upward from the back casing 1 around the second pivot axis 11, at which the part configured to be engaged with the back casing 1 via the claw portion is positioned. The expression "upward-opening" means that the second top panel 4 pivots upward from the back casing 1 around the second pivot axis 11 above the back casing 1. Then, the second top panel 4 moves upward. As a result, the barb of the first claw portion 12*a* is disconnected from the barb of the second claw portion 12*b*, and the second top panel 4 is detached from the back casing 1.

<Downward-Opening Operation of First Top Panel 3>

Figure 15:
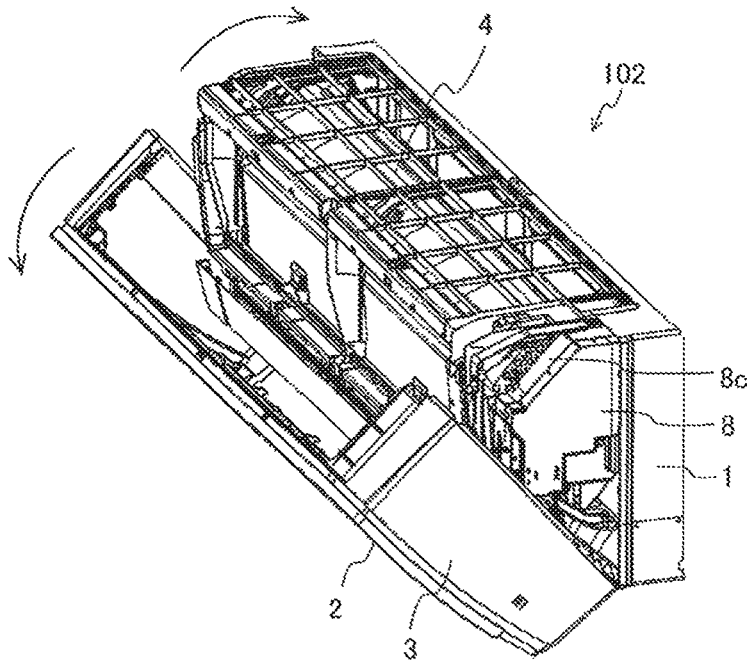
FIG. 15 is a perspective view illustrating the indoor unit of the air-conditioning apparatus according to Embodiment 1 of the present invention when the first top panel opens downward from the back casing.
Figure 16:
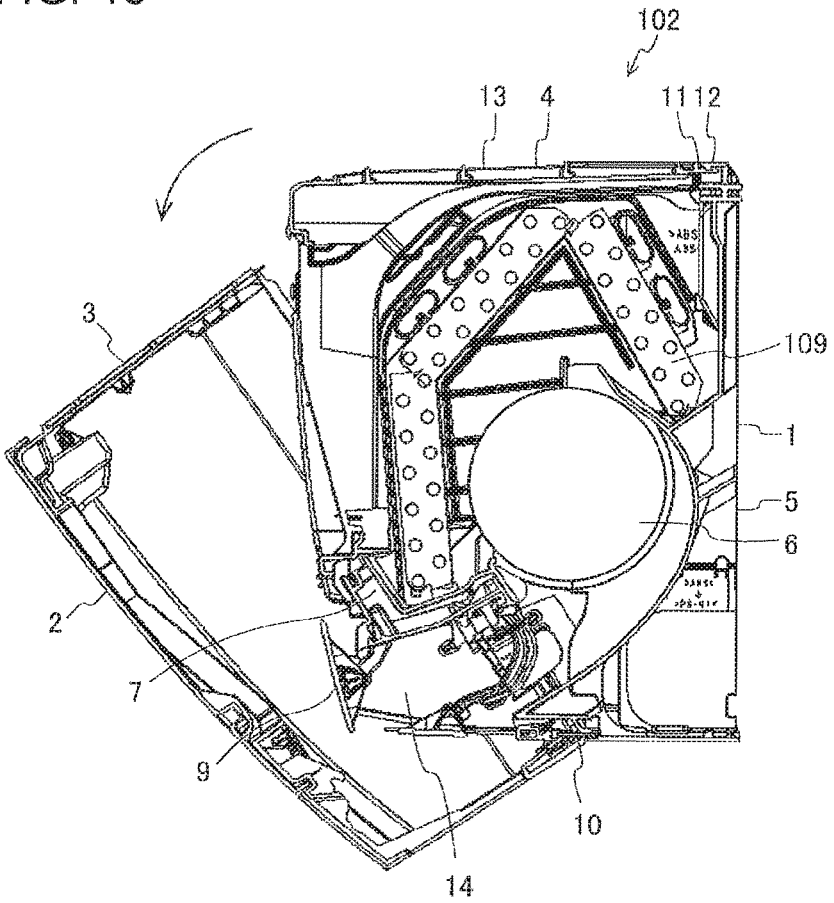
FIG. 16 is a longitudinal sectional view illustrating the vicinity of the center of the indoor unit of the air-conditioning apparatus in the lengthwise direction according to Embodiment 1 of the present invention when the first top panel opens downward from the back casing.
Figure 17:
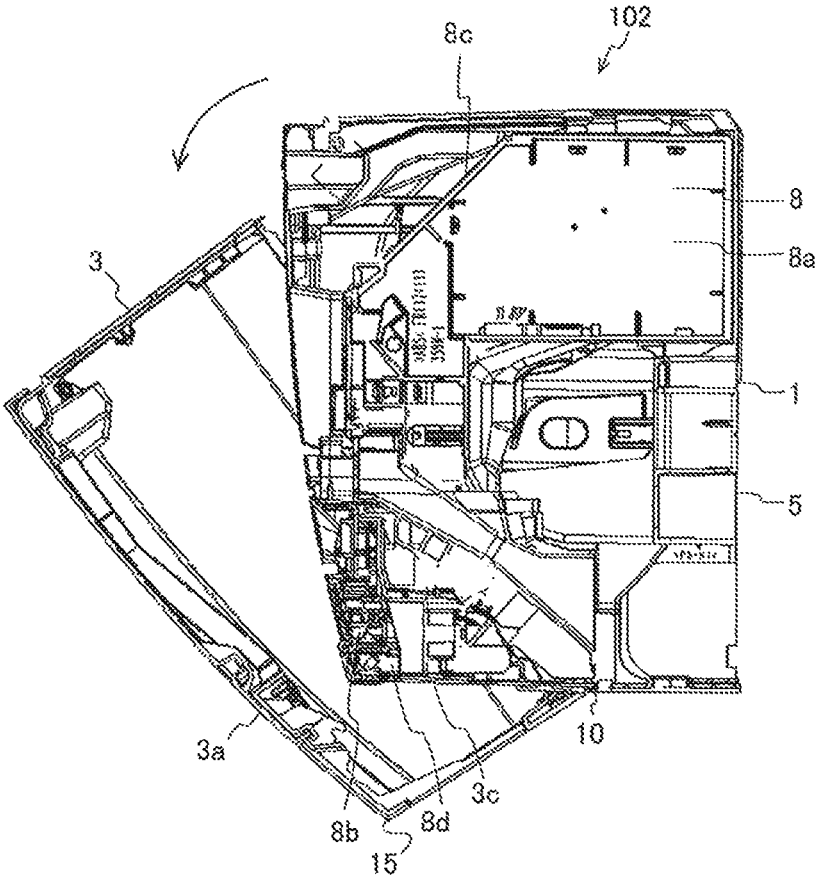
FIG. 17 is a longitudinal sectional view, at the position of the electric component box, illustrating the indoor unit of the air-conditioning apparatus according to Embodiment 1 of the present invention when the first top panel opens downward from the back casing.

FIG. 15 is a perspective view illustrating the indoor unit 102 of the air-conditioning apparatus 100 according to Embodiment 1 of the present invention when the first top panel 3 opens downward from the back casing 1. FIG. 16 is a longitudinal sectional view illustrating the vicinity of the center of the indoor unit 102 of the air-conditioning apparatus 100 in the lengthwise direction according to Embodiment 1 of the present invention when the first top panel 3 opens downward from the back casing 1. FIG. 17 is a longitudinal sectional view, at the position of the electric component box 8, illustrating the indoor unit 102 of the air-conditioning apparatus 100 according to Embodiment 1 of the present invention when the first top panel 3 opens downward from the back casing 1.

As illustrated in FIGS. 15 to 17, the first top panel 3 can open downward from the back casing 1 around the first pivot axis 10 positioned under the back casing 1. The first top panel 3 opens downward. The expression "downward-opening" means that the first top panel 3 pivots downward from the back casing 1 around the first pivot axis 10 under the back casing 1. That is, the first top panel 3 pivots downward from the back casing 1 around the first pivot axis 10 under the back casing 1 such that the pivot radius of the first top panel 3 is larger toward the top portion thereof. Then, the first top panel 3 moves downward. This configuration enables the first top panel 3 to be detached without coming into contact with internal components. Before an operator opens the first top panel 3 downward, the screws with which the first top panel 3 is fixed to an upper portion of the back casing 1 need to be unscrewed. Screwing is performed to prevent the first top panel 3 from being unintentionally detached during operation of the indoor unit 102.

Preferably, the part at the position of the first pivot axis 10 has a similar configuration in which the configuration of the claw engagement structure 12 of the second top panel 4 is inverted. That is, when the first top panel 3 is pushed into the back casing 1 from the front side, a claw portion of the first top panel 3 and a claw portion of the back casing 1 respectively slide along an inclined surface of the claw portion of the back casing 1 and an inclined surface of the claw portion of the first top panel 3. Then, the claw portion of the first top panel 3 and the claw portion of the back casing 1 are engaged with each other with their barbs not to be disconnected from each other. Meanwhile, when the first top panel 3 opens downward from the back casing 1 around the first pivot axis 10, at which the part configured to be engaged with the back casing 1 via the claw portion is positioned, the first top panel 3 moves downward. As a result, the barb of the claw portion of the first top panel 3 is disconnected from the barb of the claw portion of the back casing 1, and the first top panel 3 is detached from the back casing 1.

As illustrated in FIG. 16, when the first top panel 3 opens downward, there is no possibility that the first top panel 3 comes into contact with internal components within the width of the indoor heat exchanger 109 because the first top panel 3 has no top portion within the width of the indoor heat exchanger 109.

As illustrated in FIG. 17, when the first top panel 3 opens downward, the downward-opening pivot path region is shaped that includes a path along which the first top portion 3*b* moves physically when the first top panel 3 opens downward. For this reason, in an upper portion of the electric component box 8, the inclined portion 8*c* is so inclined that a front portion thereof is lower than a back portion thereof. Thus, the inclination of the inclined portion

8*c* in an upper portion of the electric component box 8 is outside the downward-opening pivot path region.

In addition, as illustrated in FIGS. 15 to 17, the first top panel 3 opens downward, and thus even if the bent portion 15 having an L shape is formed in a lower portion of the first top panel 3, the bent portion 15 is disposed outside the downward-opening pivot path region of the first top panel 3. Thus, it is possible to refine the shape design of a front lower portion of the indoor unit 102, the front lower portion including the remote-control communication unit 8*b* and easily catching a user's attention in a wall-mounted indoor unit.

<Related-Art Example>

Figure 18:
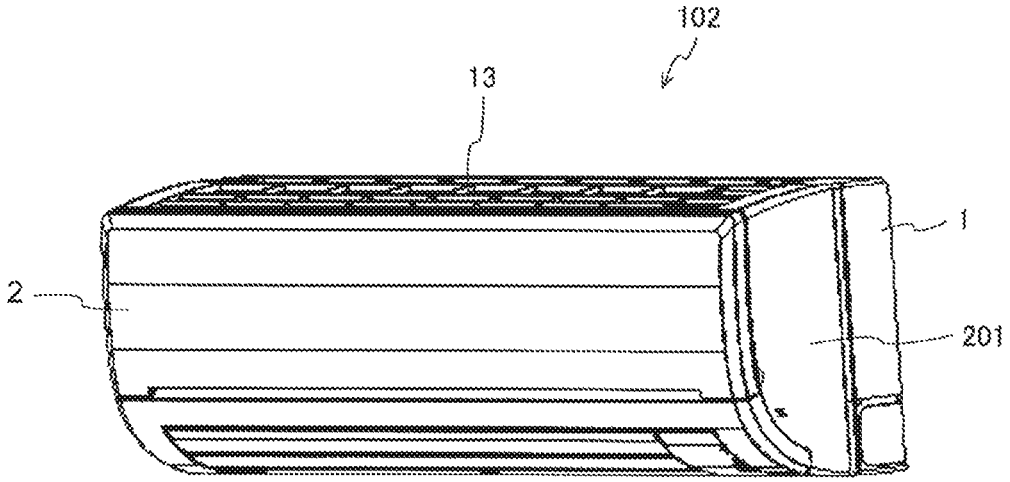
FIG. 18 is an external perspective view illustrating an indoor unit of an air-conditioning apparatus in a related-art example.
Figure 19:
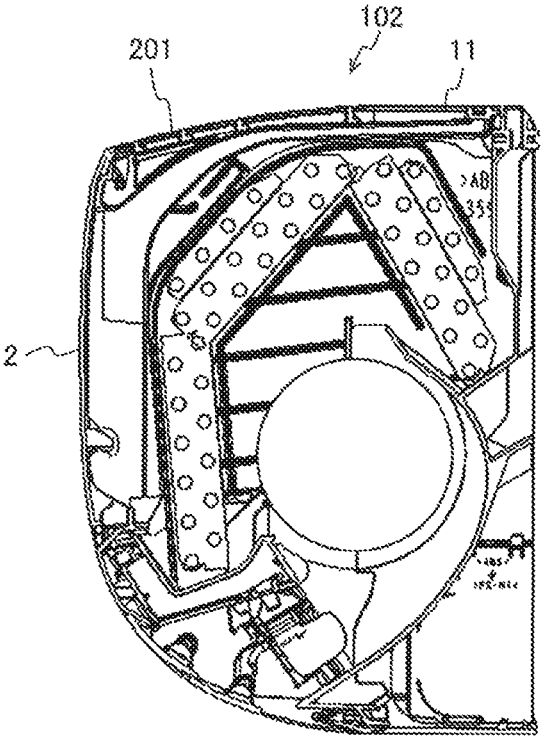
FIG. 19 is a longitudinal sectional view illustrating the indoor unit of the air-conditioning apparatus in the related-art example.
Figure 20:
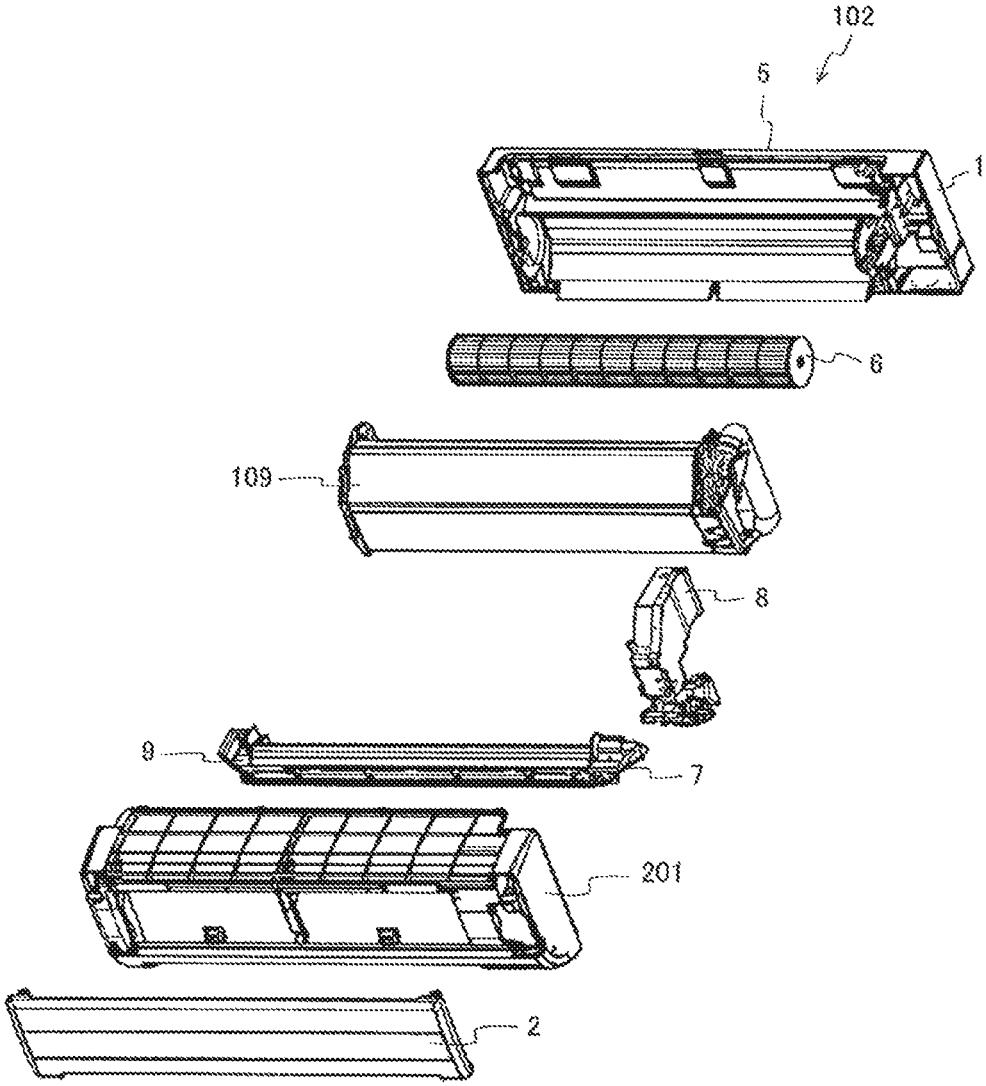
FIG. 20 is an exploded perspective view illustrating the indoor unit of the air-conditioning apparatus in the related-art example.

FIG. 18 is an external perspective view illustrating an indoor unit 102 of an air-conditioning apparatus 100 in a related-art example. FIG. 19 is a longitudinal sectional view illustrating the indoor unit 102 of the air-conditioning apparatus 100 in the related-art example. FIG. 20 is an exploded perspective view illustrating the indoor unit 102 of the air-conditioning apparatus 100 in the related-art example.

In the related-art example, the same components as those of the indoor unit 102 of the air-conditioning apparatus 100 in Embodiment 1 have the same reference signs and are not described. As illustrated in FIGS. 18 to 20, unlike the indoor unit 102 in Embodiment 1, the indoor unit 102 in the related-art example includes one top panel, that is, a top panel 201.

Figure 21:
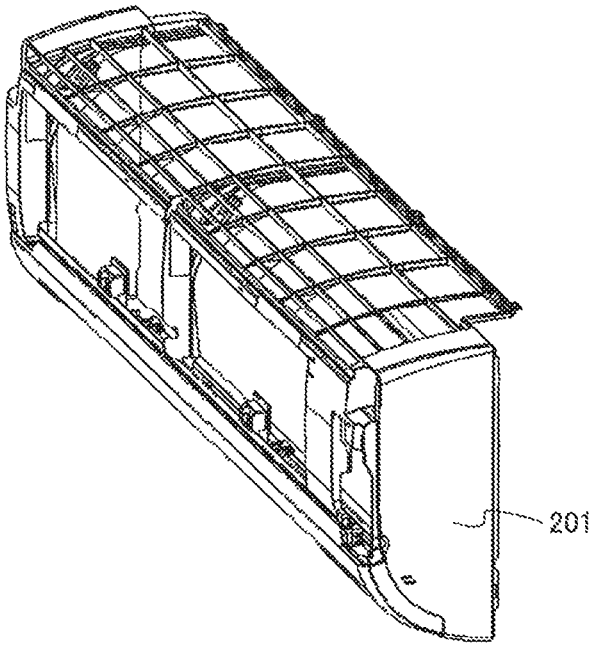
FIG. 21 is a perspective view illustrating a top panel of the indoor unit of the air-conditioning apparatus in the related-art example.

FIG. 21 is a perspective view illustrating the top panel 201 of the indoor unit 102 of the air-conditioning apparatus 100 in the related-art example. As illustrated in FIG. 21, as contrasted with the first top panel 3 and the second top panel 4 in FIG. 5 formed into two separate components, the top panel 201 in the related-art example is formed into a single component.

Figure 22:
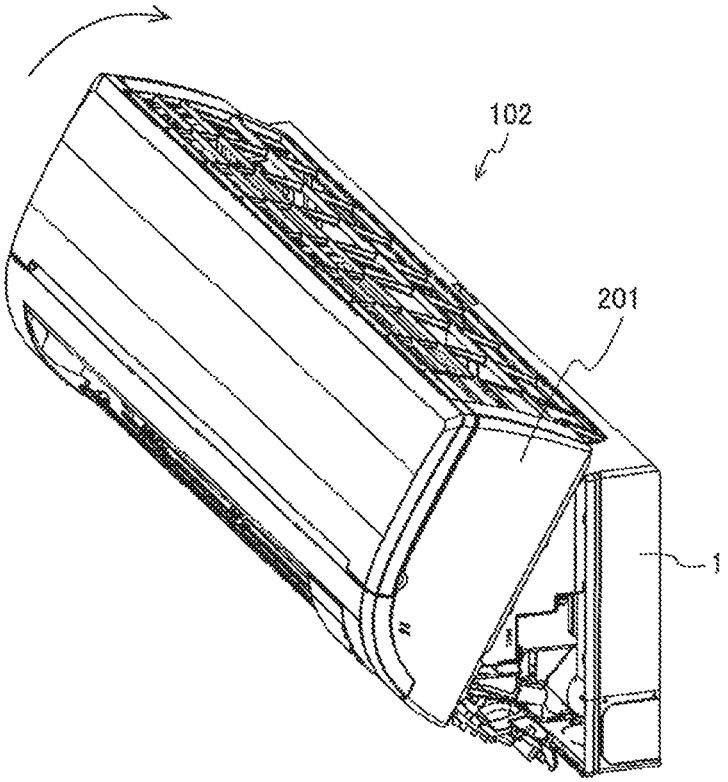
FIG. 22 is a perspective view illustrating the indoor unit of the air-conditioning apparatus in the related-art example when the top panel opens upward from a back casing.
Figure 23:
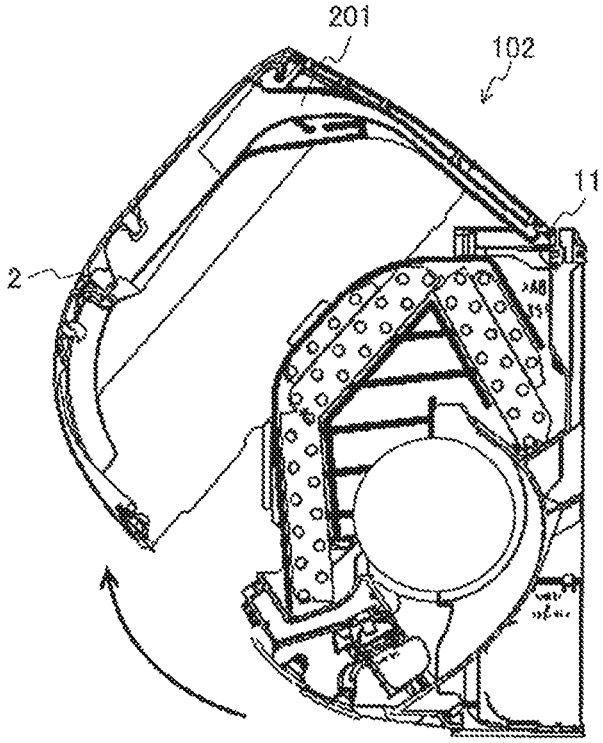
FIG. 23 is a longitudinal sectional view illustrating the indoor unit of the air-conditioning apparatus in the related-art example when the top panel opens upward from the back casing.

FIG. 22 is a perspective view illustrating the indoor unit 102 of the air-conditioning apparatus 100 in the related-art example when the top panel 201 opens upward from a back casing 1. FIG. 23 is a longitudinal sectional view illustrating the indoor unit 102 of the air-conditioning apparatus 100 in the related-art example when the top panel 201 opens upward from the back casing 1.

As illustrated in FIGS. 22 and 23, when the top panel 201 in the related-art example opens upward from the back casing 1 around a second pivot axis 11, which is positioned above the back casing 1 and at which the part configured to be engaged with the back casing 1 via a claw portion is positioned, the top panel 201 pivots upward. Then, the top panel 201 is detached in a manner similar to the manner in which, in Embodiment 1, the barb of the first claw portion 12*a* is disconnected from the second claw portion 12*b* and the second top panel 4 is detached from the back casing 1.

<Imaginary Example>

Figure 24:
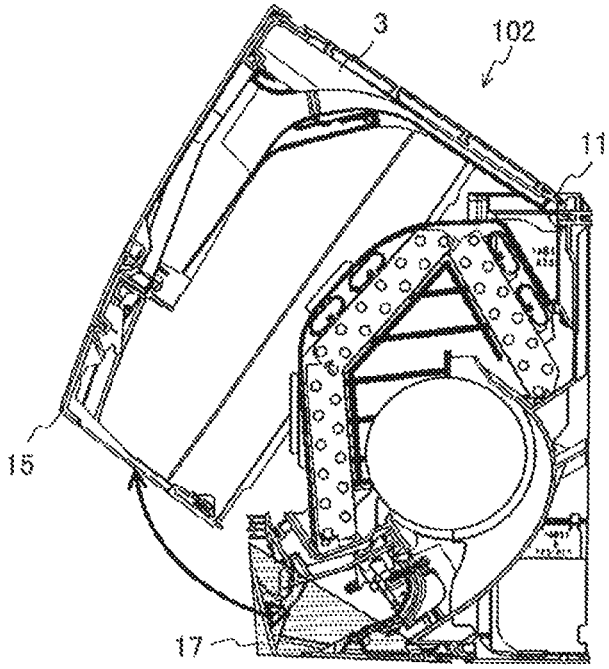
FIG. 24 is a longitudinal sectional view illustrating an indoor unit of an air-conditioning apparatus in an imaginary example when a first top panel opens upward from a back casing.

FIG. 24 is a longitudinal sectional view illustrating an indoor unit 102 of an air-conditioning apparatus 100 in an imaginary example when a first top panel 3 opens upward from a back casing 1. In the imaginary example, the same components as those of the indoor unit 102 of the air-conditioning apparatus 100 in Embodiment 1 have the same reference signs and are not described. As illustrated in FIG. 24, if the first top panel 3 in Embodiment 1 opens upward, a remote-control communication unit 8*b* of an electric component box 8 is within a pivot path region 17, within which a bent portion 15 of the first top panel 3 moves, and the pivoting of the first top panel 3 is obstructed. For this reason, as in the related-art example, a lower portion of the top panel 201 is shaped into a curved surface not to obstruct the pivoting of the top panel 201. As described above, in the related-art example, there is a restriction on the shape design of the lower portion of the top panel 201. Thus, there is a restriction on the shape design of the front lower portion of the indoor unit 102, the front lower portion including the remote-control communication unit 8*b* and easily catching a user's attention in a wall-mounted indoor unit. The problem is solved with the indoor unit 102 of the air-conditioning apparatus 100 in Embodiment 1 above.

<Effects of Embodiment 1>

According to Embodiment 1, the indoor unit 102 of the air-conditioning apparatus 100 includes the back casing 1. The indoor unit 102 of the air-conditioning apparatus 100 includes the first top panel 3, which has the first pivot axis 10 under the back casing 1 and is configured to be attached to the back casing 1. The first top panel 3 is configured to be detached from the back casing 1 by opening downward from the back casing 1 around the first pivot axis 10.

With this configuration, it is possible to make a shape design of the indoor unit 102 such that the remote-control communication unit 8*b* at a lower position in the first top panel 3 is disposed outside the pivot path of the first top panel 3 to be detached. Thus, the shape design of the front lower portion of the indoor unit 102 is beautified, the front lower portion including the remote-control communication unit 8*b* and easily catching a user's attention in a wall-mounted indoor unit. In such a manner, the restriction on the shape design of the indoor unit 102 is eliminated.

According to Embodiment 1, the indoor unit 102 of the air-conditioning apparatus 100 includes the electric component box 8. When the first top panel 3 opens downward, the downward-opening pivot path region including a path along which the first top panel 3 moves is shaped. In an upper portion of the electric component box 8, the inclined portion 8*c* is formed to be disposed outside the downward-opening pivot path region such that a front portion of the inclined portion 8*c* is lower than a back portion of the inclined portion 8*c*.

This configuration enables the first top panel 3 to be detached from the back casing 1 by opening downward from the back casing 1 around the first pivot axis 10. Thus, an upper portion of the electric component box 8 may block a path in the downward-opening pivot path region of the first top panel 3. For this reason, in the upper portion of the electric component box 8, the inclined portion 8*c* is formed such that the front portion of the inclined portion 8*c* is lower than the back portion of the inclined portion 8*c*, and the upper portion of the electric component box 8 is disposed outside the downward-opening pivot path region of the first top panel 3.

According to Embodiment 1, the indoor unit 102 of the air-conditioning apparatus 100 includes a heat exchanger. The electric component box 8 is disposed parallel to one end in the left-right direction of the indoor heat exchanger 109. The first top panel 3 includes the first top portions 3*b* outside the left-right width of the indoor heat exchanger 109.

With this configuration, when the first top portion 3*b* moves downward, the downward-opening pivot path region of the first top panel 3 is shaped outside the left-right width of the indoor heat exchanger 109, and the first top portion 3*b* may come into contact with the electric component box 8, which is an internal component. For this reason, in the upper portion of the electric component box 8, the inclined portion 8*c* is formed such that the front portion of the inclined portion 8*c* is lower than the back portion of the inclined portion 8*c*, and the upper portion of the electric component box 8 is disposed outside the downward-opening pivot path region of the first top portion 3*b* of the first top panel 3.

According to Embodiment 1, one of the first top portions 3*b* is disposed above the electric component box 8.

With this configuration, when the first top portion 3*b* moves downward, the downward-opening pivot path region of the first top panel 3 is shaped in the upper portion of the electric component box 8, and the first top portion 3*b* may come into contact with the electric component box 8. For this reason, in the upper portion of the electric component box 8, the inclined portion 8*c* is formed such that the front portion of the inclined portion 8*c* is lower than the back portion of the inclined portion 8*c*, and the upper portion of the electric component box 8 is disposed outside the downward-opening pivot path region of the first top portion 3*b* of the first top panel 3.

According to Embodiment 1, the first top panel 3 includes the left and right side portions 3*d* of the casing 5. Each of the first top portions 3*b* is continuous with a corresponding one of the left and right side portions 3*d*.

With this configuration, the front of the casing 5 is composed of the first top panel 3 including the left and right side portions 3*d* of the casing 5, and each of the first top portions 3*b* is continuous with a corresponding one of the left and right side portions 3*d*. As a result, it is possible to increase the strength of the first top panel 3.

According to Embodiment 1, the first top panel 3 includes, in a lower portion of the first top panel 3, the bent portion 15, which connects the first front portion 3*a* and the bottom portion 3*c*. The electric component box 8 includes the remote-control communication unit 8*b* in a lower portion of the electric component box 8. The remote-control communication unit 8*b* is disposed inside the bent portion 15 of the first top panel 3.

With this configuration, the remote-control communication unit 8*b* is disposed inside the bent portion 15 of the first top panel 3 and can communicate with the remote control without interference. In addition, the shape design of the front lower portion of the indoor unit 102 is diversified with the bent portion 15, the front lower portion including the remote-control communication unit 8*b* and easily catching a user's attention in a wall-mounted indoor unit, and thus the design can be refined.

According to Embodiment 1, the bent portion 15 has an L shape.

With this configuration, the bent portion 15, having an L shape, achieves the shape design beautified in L shape of the front lower portion of the indoor unit 102, the front lower portion including the remote-control communication unit 8*b* and easily catching a user's attention in a wall-mounted indoor unit.

According to Embodiment 1, the indoor unit 102 of the air-conditioning apparatus 100 includes the second top panel 4, which has the second pivot axis 11 above the back casing 1 and overlaps the inside of the first top panel 3. The second top panel 4 is configured to be detached from the back casing 1 by opening upward from the back casing 1 around the second pivot axis 11.

With this configuration, the indoor unit 102 includes the second top panel 4, and thus the second top panel 4 can make up for parts that the first top panel 3 lacks and are required for the front of the casing 5.

According to Embodiment 1, the part at the position of the second pivot axis 11 of the second top panel 4 is configured to be engaged with the back casing 1 via the claw portion.

With this configuration, the second top panel 4 overlaps the inside of the first top panel 3 by being engaged with the back casing 1 via the claw portion and is configured to be easily detached from the back casing 1 by opening upward from the back casing 1 around the second pivot axis 11 above the back casing 1.

According to Embodiment 1, the second top panel 4 includes the second top portion 4*b*, which has a grid shape and is to be the air inlet 13 within the left-right width of the indoor heat exchanger 109.

With this configuration, the second top panel 4 can make up for parts that the first top panel 3 lacks and that are required for the front of the casing 5 with the second top portion 4*b*, which has a grid shape and is to be the air inlet 13.

According to Embodiment 1, the second top panel 4 includes the second front portion 4*a*, which has a left-right width equal to the left-right width of the second top portion 4*b* and is continuous with the second top portion 4*b*.

With this configuration, in the second top panel 4, in addition to the second top portion 4*b*, the second front portion 4*a* is also connected to the left and right end portions. As a result, it is possible to increase the strength of the second top panel 4.

According to Embodiment 1, the air-conditioning apparatus 100 includes the indoor unit 102 of the air-conditioning apparatus 100.

With this configuration, in the air-conditioning apparatus 100 including the indoor unit 102 of the air-conditioning apparatus 100, it is possible to make a shape design of the indoor unit 102 such that the remote-control communication unit 8*b* at the lower position in the first top panel 3 is disposed outside the pivot path of the first top panel 3 to be detached. Thus, the shape design of the front lower portion of the indoor unit 102 is beautified, the front lower portion including the remote-control communication unit 8*b* and easily catching a user's attention in a wall-mounted indoor unit. In such a manner, the restriction on the shape design of the indoor unit 102 is eliminated.

REFERENCE SIGNS LIST

1 back casing 1*a* top portion 2 front design panel 3 first top panel 3*a* first front portion 3*b* first top portion 3*c* bottom portion 3*d* side portion 4 second top panel 4*a* second front portion 4*b* second top portion 5 casing 6 fan 7 drain pan 8 electric component box 8*a* control unit 8*b* remote-control communication unit 8*c* inclined portion 8*d* corner portion 9 airflow direction louver unit 10 first pivot axis 11 second pivot axis 12 claw engagement structure 12*a* first claw portion 12*b* second claw portion 13 air inlet 14 air outlet 15 bent portion 16 display 17 pivot path region 100 air-conditioning apparatus 101 outdoor unit 102 indoor unit 103 gas refrigerant pipe 104 liquid refrigerant pipe 105 compressor 106 four-way valve 107 outdoor heat exchanger 108 expansion valve 109 indoor heat exchanger 201 top panel

The invention claimed is:

1. An indoor unit of an air-conditioning apparatus, comprising:

a back casing; and a first top panel having a first pivot axis under the back casing, the first top panel being configured to be attached to the back casing, wherein the first top panel is configured to be detached from the back casing by opening downward from the back casing around the first pivot axis, the indoor unit comprising an electric component box, wherein when the first top panel opens downward, a downward-opening pivot path region including a path along which the first top panel moves is shaped, and an upper portion of the electric component box is formed to be disposed outside the downward-opening pivot path region such that a front portion of the upper portion is lower than a back portion of the upper portion, the first top panel further includes, in a lower portion of the first top panel, a bent portion that connects a first front portion and a bottom portion, the electric component box includes a remote-control communication unit in a lower portion of the electric component box, and the remote-control communication unit is disposed inside the bent portion of the first top panel.

2. The indoor unit of an air-conditioning apparatus of claim 1, further comprising a heat exchanger, wherein the electric component box is disposed parallel to one end in a left-right direction of the heat exchanger, and the first top panel includes a plurality of first top portions outside a left-right width of the heat exchanger.

3. The indoor unit of an air-conditioning apparatus of claim 2, wherein one of the plurality of first top portions is disposed above the electric component box.

4. The indoor unit of an air-conditioning apparatus of claim 2, wherein the first top panel further includes a left side portion and a right side portion of a casing, and each of the plurality of first top portions is continuous with a corresponding one of the left and right side portions.

5. The indoor unit of an air-conditioning apparatus of claim 1, wherein the bent portion has an L shape.

6. An air-conditioning apparatus comprising the indoor unit of an air-conditioning apparatus of claim 1.

7. An indoor unit of an air-conditioning apparatus, comprising:

a back casing; and a first top panel having a first pivot axis located at a bottom rear of the first top panel and under the back casing, the first top panel being configured to be attached to the back casing, wherein the first top panel is configured to be detached from the back casing by opening downward from the back casing around the first pivot axis, wherein the indoor unit comprises a second top panel having a second pivot axis located at a top rear of the second top panel and above the back casing, the second top panel overlapping an inside of the first top panel, and wherein the second top panel is configured to be detached from the back casing by opening upward from the back casing around the second pivot axis.

8. The indoor unit of claim 7, further comprising an electric component box, wherein when the first top panel opens downward, a downward-opening pivot path region including a path along which the first top panel moves is shaped, and an upper portion of the electric component box is formed to be disposed outside the downward-opening pivot path region such that a front portion of the upper portion is lower than a back portion of the upper portion.

9. The indoor unit of an air-conditioning apparatus of claim 8, further comprising a heat exchanger, wherein the electric component box is disposed parallel to one end in a left-right direction of the heat exchanger, and the first top panel includes a plurality of first top portions outside a left-right width of the heat exchanger.

10. The indoor unit of an air-conditioning apparatus of claim 9, wherein one of the plurality of first top portions is disposed above the electric component box.

11. The indoor unit of an air-conditioning apparatus of claim 9, wherein the first top panel further includes a left side portion and a right side portion of a casing, and each of the plurality of first top portions is continuous with a corresponding one of the left and right side portions.

12. The indoor unit of claim 8, wherein the first top panel further includes, in a lower portion of the first top panel, a bent portion that connects a first front portion and a bottom portion, the electric component box includes a remote-control communication unit in a lower portion of the electric component box, and the remote-control communication unit is disposed inside the bent portion of the first top panel.

13. The indoor unit of an air-conditioning apparatus of claim 12, wherein the bent portion has an L shape.

14. The indoor unit of an air-conditioning apparatus of claim 7, wherein a part at a position of the second pivot axis of the second top panel is configured to be engaged with the back casing via a claw portion.

15. The indoor unit of an air-conditioning apparatus of claim 7, wherein the second top panel includes a second top portion having a grid shape and configured to be an air inlet within the left-right width of the heat exchanger.

16. The indoor unit of an air-conditioning apparatus of claim 15, wherein the second top panel further includes a second front portion, and the second front portion has a left-right width equal to a left-right width of the second top portion and is continuous with the second top portion.

17. An air-conditioning apparatus comprising the indoor unit of an air-conditioning apparatus of any one of claim 7.

18. An indoor unit of an air-conditioning apparatus, comprising:

a back casing; and a first top panel having a first pivot axis under the back casing, the first top panel being configured to be attached to the back casing, wherein the first top panel is configured to be detached from the back casing by opening downward from the back casing around the first pivot axis, the indoor unit comprises a second top panel having a second pivot axis above the back casing, the second top panel overlapping an inside of the first top panel, the second top panel is configured to be detached from the back casing by opening upward from the back casing around the second pivot axis, and the second top panel includes a second top portion having a grid shape and configured to be an air inlet within the left-right width of the heat exchanger.

19. The indoor unit of the air-conditioning apparatus of claim 18, wherein the second top panel further includes a second front portion, and the second front portion has a left-right width equal to a left-right width of the second top portion and is continuous with the second top portion.

* * * * *